United States Patent [19]

Inzerill

[11] 3,937,511

[45] Feb. 10, 1976

[54] MORTAR TOOL

[76] Inventor: Andrew J. Inzerill, 24 Mill St., Tobyhanna, Pa. 18466

[22] Filed: Aug. 15, 1974

[21] Appl. No.: 497,664

[52] U.S. Cl. ..... 294/16; 52/749; 294/1 R; 294/118

[51] Int. Cl.[2] ..... E04G 21/20

[58] Field of Search ..... 294/1 R, 3.5, 16, 28, 31, 294/62, 86 R, 104, 106, 118; 52/749, DIG. 1

[56] References Cited

UNITED STATES PATENTS

| | | | |
|---|---|---|---|
| 1,573,263 | 2/1926 | Madden | 52/749 |
| 2,561,207 | 7/1951 | Kellner | 294/119 |
| 2,632,275 | 3/1953 | Richardson | 294/118 X |
| 2,657,571 | 11/1953 | Looze | 294/16 X |
| 2,694,595 | 11/1954 | Garris | 294/16 |
| 2,940,298 | 6/1960 | Joseph | 52/749 |
| 3,129,029 | 4/1964 | Ruzza | 294/62 |
| 3,696,576 | 10/1972 | deBarros | 52/749 X |

*Primary Examiner*—Evon C. Blunk
*Assistant Examiner*—Johnny D. Cherry
*Attorney, Agent, or Firm*—John B. Dickman, III

[57] ABSTRACT

A mortar tool for grasping a bead of mortar and placing it on top of the course of bricks or blocks being laid. The device includes a pair of opposed elongate jaws which are spring biased to open position and have handles or a pistol grip for closing the jaws to retain mortar therein. The device is then moved to engage the top of a course of bricks or blocks and with attached guides is aligned therewith and the handle or pistol is then released to open the jaws to deposit the bead of mortar onto the work.

5 Claims, 9 Drawing Figures

MORTAR TOOL

BACKGROUND OF THE INVENTION

Field of the Invention

The present invention relates to the brick laying and block lying art and is directed to a tool for depositing a bead of mortar on the top of the laid course.

SUMMARY OF THE INVENTION

The present device includes a pair of jaws which are spring biased to open position and are closed by squeezing handles or a pistol grip to retain a bead of mortar therein. After the tool is brought to the proper position utilizing guides attached thereto the handles are released to open the jaws and deposit the bead of mortar on top of the course of blocks or bricks.

The primary object of the invention is to provide a mortar tool which will accurately and evenly deposit a predetermined bead of mortar on top of a course of blocks or bricks. Up to date it is done by trowel to pick up mortar and lay it evenly on a block without dropping, which requires skill and experience, but with this invention even a novice or "do it yourselfer" could pick up mortar with ease, accuracy and speed by simply dipping the tool into the mortar a predetermined distance. The mortar tool can be made as long as a cement block or longer and a level bubble may be attached to the tool to make it easier to observe if the block or mortar is laid level.

Other objects and advantages will become apparent in the following specification when considered in the light of the attached dawings.

DESCRIPTION OF THE PREFERRED EMBODIMENTS

Figure 1:
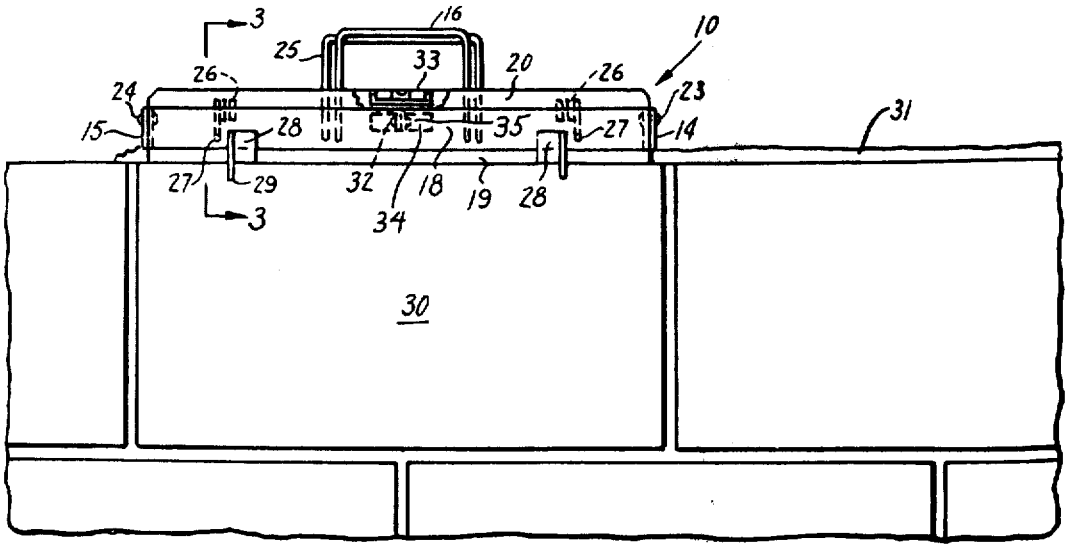
FIG. 1 is a side elevation of the invention.

Referring now to the drawings in detail wherein like reference characters indicate like parts throughout the several figures the reference numeral 10 indicates generally a mortar tool constructed in accordance with the invention.

The mortar tool 10 includes a generally flat jaw 11 having a lip 12 integrally formed on the lower edge thereof and extending at a slight angle thereto only when open, as a means of allowing mortar to flow out easier since it offers no resistance when open. An outwardly flared back 13 is integrally formed along the upper edge of the jaw 11, as a means of reinforcement.

An ear 14 is integrally formed on one end of the jaw 11 and extends perpendicularly thereto oppositely of the lip 12 and the back 13. A second ear 15 is integrally formed on the opposite end of the jaw 11 and extends parallel to the ear 14. A generally U-shaped wire handle 16 has its opposite ends integrally secured to the jaw 11 intermediate the ears 14, 15. The handle 16 is inwardly offset at 17 as can be clearly seen in FIG. 4.

A generally rectangular jaw 18 is positioned in opposed relation to the jaw 11 and has a lip 19 integrally formed on the lower edge thereof and extending at a slight angle thereto. A back 20 is integrally formed on the upper edge of the jaw 18 and extends outwardly therefrom at an angle. An ear 21 is integrally formed on one end of the jaw 18 and extends perpendicularly thereto oppositely of the lip 19 and the back 20. An ear 22 is integrally formed on the opposite end of the jaw 18 and extends parallel to the ear 21.

Figure 4:
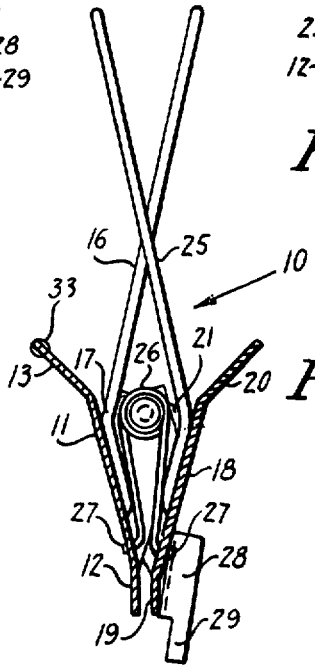
FIG. 4 is an enlarged cross-sectional view similar to FIG. 3 showing the jaws in in an almost closed position, the jaws being perfectly flush when fully closed.
Figure 6:
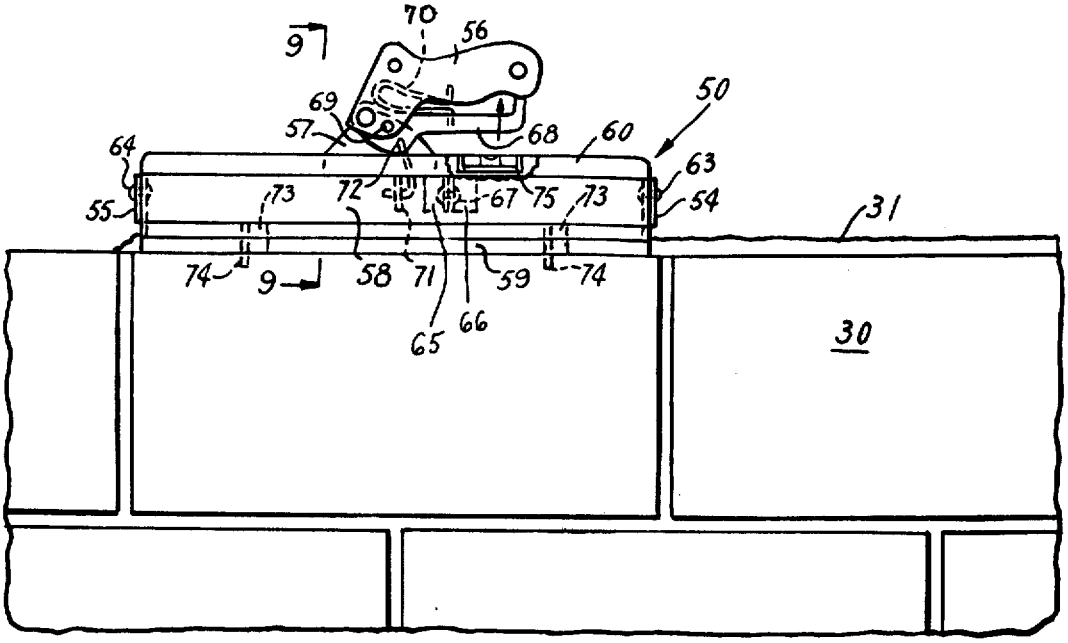
FIG. 6 is a front elevation of a modified form of the invention.
Figure 7:
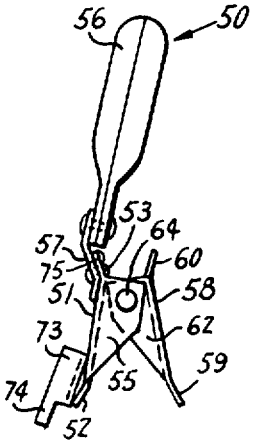
FIG. 7 is an end elevation of the device illustrated in FIG. 6 with the jaws in opened position.
Figure 8:
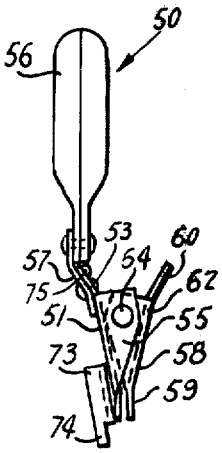
FIG. 8 is a view similar to FIG. 7 illustrating the jaws in an almost closed position.
Figure 9:
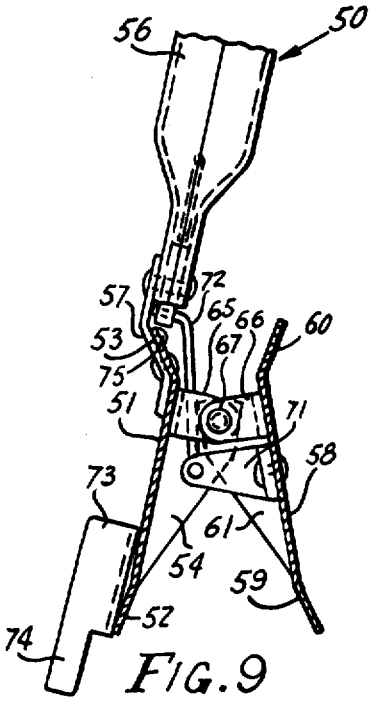
FIG. 9 is an enlarged transverse cross-section taken along the line 9—9 of FIG. 6 looking in the direction of the arrows.

The ears 14, 21 and the ears 15, 22 are pivotally mounted on pivot pins 23, 24 respectively to mount the jaws 11, 18 for pivotal movement with respect to each other. A generally U-shaped handle 25 has its free ends secured to the interface of the jaw 18 and extends upwardly and inwardly therefrom being angularly offset as can be seen in FIG. 4. The handle 25 has a length slightly less then the handle 16 so that it may be interfitted therewith.

A pair of coil springs 26 are fitted between the jaws 11, 18 and have their terminal ends 27 extending through holes in the jaws 11, 18 adjacent the lips 12, 19 so that lips 12, 19 are spring biased outwardly away from each other, thus allowing mortar to descent when open, but when fully closed both jaws and ears come together. Ears 14 and 21, 15 and 22 are so designed as shown in FIGS. 2 and 3 that when in a closed position retain the mortar.

A pair of guide members 28 are secured to the jaw 18 and have a depending guide finger 29 exending below the lip 19 to engage the side of the block 30 as can be seen in FIG. 1 to maintain the alignment of the tool 10 therewith. The reinforcement leaf hinge 32 is secured to the jaw 11 and a leaf hinge 34 is secured to the jaw 18, the leaves 32 and 34 are connected for pivotal movement by a pivot pin 35 extending there through and the pivot pins 23, 24 and 35 are arranged in axial alignment. The hinge leaves 32 and 34 are arranged intermediate the opposie ends of tool 10. The pair of guide members are actually a gage to space evenly and align the mortar parallel to the block which also guides and levels the mortar, since it can be observed by looking at the level bubble 33 mounted on the top in the center of the jaw 11.

Figure 2:
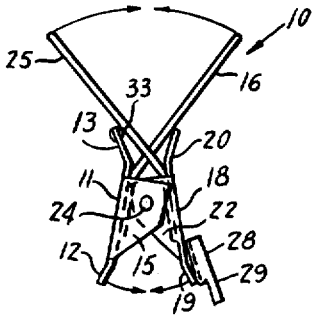
FIG. 2 is an end elevation of the invention.
Figure 3:
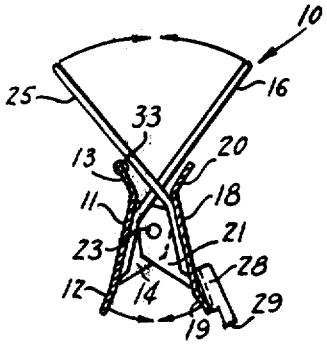
FIG. 3 is a transverse cross-section taken along the line 3—3 of FIG. 1 looking in the direction of the arrows.
Figure 5:
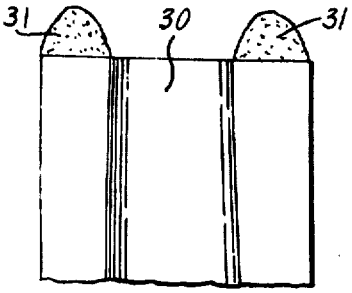
FIG. 5 is an end elevational view of a cinder block having the bead of mortar placed thereon.

In the use and operation of the tool 10 the handles 16, 25 are released so that the jaws 11, 18 can open to the position illustrated on FIGS. 2 and 3. In this position the tool 10 is pressed downwardly into a supply of wet mortar and the handles 16, 25 are grasped and moved toward each other to completely close the jaws 11, 18. The position illustrated in FIG. 4 shows the jaws are not fully closed, but when fully closed both jaws and ears come together. Ears 14 and 21, 15 and 22 are so designed as shown in FIGS. 2 and 3 so that they retain the mortar when in a closed position. The outwardly extending lips will be in parallel relation when in closed position. The tool 10 is then moved with the lips 12, 19 engaging the top of a block 30 and the guide fingers 29 engaging the side of the block 30. In this position the handles 16, 25 are released and the jaws 11, 18 open depositing a bead of mortar 31 on top of the block 30. The operation is continued until sufficient beads 31 have been placed along the course to permit the next course to be laid.

Referring now to FIGS. 6 through 9 a modified mortar tool is indicated generally at 50 which is basically the same except for the handle.

The tool 50 includes a generally rectangular jaw 51 having a lip 52 integrally formed on its lower edge and extending angularly with respect thereto. A back 53 is integrally secured to the upper edge of the jaw 51 and extends angularly outwardly therefrom.

An ear 54 is integrally formed on one end of the jaw 51 and extends perpendicularly thereto oppositely of the lip 52 and the back 53. An ear 55 is integrally secured to the opposite end of the jaw 51 and extends parallel to the ear 54. A pistol grip handle 56 is rigidly secured to a bracket 57 carried by the jaw 51 and back 53.

A generally rectangular jaw 58 is positioned in opposed relation to the jaw 51 and has a lip 59 integrally formed on the lower edge thereof extending angularly outwardly away from the lip 52. A generally rectangular back 60 is integrally formed along the upper edge of the jaw 58 as a reinforcement and extends angularly outwardly therefrom oppositely of the back 53.

An ear 61 is integrally formed on one end of the jaw 58 and extends perpendicularly therefrom oppositely of the lip 59 and the back 60. An ear 62 is integrally formed on the opposite end of the jaw 58 and extends perpendicularly thereto parallel to the ear 61. The ears 54, 61 are secured together for pivotal movement by a pivot pin 63 and the ears 55, 62 are secured together for pivotal movement by a pivot pin 64. A hinge leaf 65 is secured to the jaw 51 and a hinge leaf 66 is secured to the jaw 58. The leaves 65, 66 are connected for pivotal movement by a pivot pin 67 extending therethrough. The pivot pins 63, 64, and 67 are arranged in axial alignment. The hinge leafs 65, 66 are arranged intermediate the opposite ends of the tool 50 as a means of reinforcement.

A grip member 68 is pivotally mounted in the pistol grip 56 on a pivot pin 69 and a spring 70 in the pistol grip 56 normally urges the grip member 68 downwardly away from the pistol grip 56. A bracket 71 is secured to the inner face of the jaw member 58 and extends inwardly therefrom. A link 72 connects the bracket 71 with the grip member 68 so that pivotal movement of the grip member 68 will pivot the jaw member 58 about the pivot pins 63, 64 and 67 drawing the jaws 51, 58 together. Upon release of the grip member 68 the spring 70 will cause the grip member 68 to swing downwardly moving the jaws 51, 58 apart. A pair of oppositely disposed guide members 73 are secured to the jaw 51 and have depending guide finges 74 integrally formed thereon.

The pair of guide members are actually a gage to space evenly and align the mortar parallel to the block which also guides and levels the mortar, since it can be observed by looking at the level bubble 75 mounted on the top in the center of the jaw 51.

The tool 50 is used in the identical manner to the tool 10 with the exception of the jaws 51, 58 which are moved by the pistol grip 56 and grip member 68 instead of the handles 16, 25.

Having thus described the preferred embodiments of the invention it should be understood that numerous structural modifications and adaptations may be resorted to without departing from the spirit of the invention.

What is claimed is:

1. A mortar tool comprising a pair of elongated generally rectangularly shaped, accurately spaced apart jaws, mating hinge means at the remote ends of each of said rectangularly shaped jaws and at the center portions thereof, a pair of guides having integral depending guide fingers secured to one of said jaws, spring loaded means normally urging said jaws apart, and hand activated means for moving said jaws together to hold mortar.

2. A device as claimed in claim 1 wherein said jaws each have an outwardly extending integral lip along the lower edge thereof, to prevent mortar from escaping when in a closed parallel related position.

3. A device as claimed in claim 2 wherein each of said jaws has an outwardly extending integral back member extending along the upper edge thereof as a reinforcement.

4. A device as claimed in claim 3 wherein the hand activated means for moving said jaws together comprises a handle member secured to each of said jaws with said handle members crossed to close said jaws as the handle members are drawn together.

5. A device as claimed in claim 3 wherein the means for moving said jaws together comprises a pistol grip secured to one of said jaws, a grip member pivotally secured to said pistol grip, and means extending from said grip member to the other of said jaws for moving said jaws together upon moving said grip member toward said pistol grip comprising a bracket attached to one of said jaws, and a link connecting said bracket to said grip member, whereby squeezing of said grip member will cause said link to act through said bracket to pivotally move said one jaw toward the other jaw.

* * * * *